US005790081A

United States Patent [19]

Unwin

[11] Patent Number: 5,790,081

[45] Date of Patent: Aug. 4, 1998

[54] CONSTANT IMPEDANCE MATCHING SYSTEM

[76] Inventor: Art H. Unwin, R. 13, Box 9, Bloomington, Ill. 61704

[21] Appl. No.: 594,096

[22] Filed: Jan. 30, 1996

[51] Int. Cl.[6] ..... H01Q 9/16

[52] U.S. Cl. ..... 343/792; 343/745; 343/790; 343/820

[58] Field of Search ..... 343/790, 791, 343/792, 820, 855, 857, 862, 863, 865, 745

[56] References Cited

U.S. PATENT DOCUMENTS

| | | | |
|---|---|---|---|
| 2,945,227 | 7/1960 | Broussard | 343/791 |
| 3,594,797 | 7/1971 | Pereda | 343/820 X |
| 3,611,397 | 10/1971 | Poliakoff | 343/792 |
| 3,713,166 | 1/1973 | Munson et al. | 343/792 |
| 4,564,843 | 1/1986 | Cooper | 343/745 |
| 4,785,308 | 11/1988 | Neucomb | 343/818 X |
| 4,893,131 | 1/1990 | Smith et al. | 343/745 X |
| 5,473,336 | 12/1995 | Holman et al. | 343/790 |

OTHER PUBLICATIONS

*The ARRL Handbook for Radio Amateurs*, 17–1 to 17–22 (The American Radio League 1992).

*Primary Examiner*—Donald T. Hajec
*Assistant Examiner*—Tho Phan

[57] ABSTRACT

A feed line is coupled to a driven element of an antenna using capacitive coupling elements, such as coupling rods, coupling wires, or conductive tape. The capacitive coupling elements allow signal transfer to or from the radiating element at an optimal transfer point, despite the fact that the optimal transfer point varies with respect to frequency. Conductive extensions may be electrically connected to the capacitive coupling elements to increase the available capacitive coupling. The constant impedance matching system provides a broader frequency response and lower standing wave ratio (SWR) to create a more efficient signal transfer to or from the driven element. A switch may be provided to directly connect and disconnect the capacitive coupling elements from the driven element and allow a choice between the broader frequency response with a flatter SWR curve and a focused frequency response with a sharper SWR curve. Also, use of capacitive coupling elements reduces the frequency consciousness of an antenna and allows radiating phasing lines to connect a driven element to a secondary element to drive the secondary element in phase or out of phase with the driven element.

13 Claims, 13 Drawing Sheets

CONSTANT IMPEDANCE MATCHING SYSTEM

CROSS REFERENCE TO RELATED APPLICATIONS

The subject matter of this patent application is related to the subject matter of U.S. patent application Ser. No. 08/406,421 filed Mar. 20,1995 by inventor Art Unwin. The disclosure of the above-mentioned U.S. Patent Application is herein incorporated by reference.

BACKGROUND OF THE INVENTION

1. Field of the Invention

This invention relates to a system for efficient transfer of radio frequency (RF) energy from an energy source to a radiating system or vice versa. More specifically, this invention relates to a matching system for efficient transfer of RF energy to and from antennas having at least one driven element.

Also, this invention relates to antennas that are capable of operating on more than one frequency band using remote tuning. This invention is particularly useful for expanding the usable frequency span of an antenna at high efficiencies for amateur radio, commercial radio, and military applications.

2. Discussion of the Related Technology

The operating bandwidth of any directional antenna may be specified in terms of standing wave ratio (SWR) on the feed line, pattern degradation, or loss of gain. The effective bandwidth of an antenna is commonly specified as a maximum value of SWR and is usually limited to 2:1 or 3:1. A low SWR is desirable to increase antenna efficiency. Operation of a high SWR on the effective bandwidth will result in a high SWR on the transmission line and a degradation of forward gain and front-to-back gain ratio. In most instances, bandwidth is limited by the matching device between the antenna and the signal feed line, rather than by the antenna characteristics. For example, when adjusted for maximum gain, the bandwidth of a typical three-element Yagi antenna is about 2.5 percent of the design frequency, due to SWR limitations. This means that an antenna array cut to 14.15 MHz would have a bandwidth of only about 350 kHz, centered on the design frequency, between the 2:1 SWR points on a transmission line. In like fashion, for an antenna beam designed for ten-meter operation at 28.5 MHz, the antenna array should be cut for low or high frequency operation in the band.

The Variable Capacitance Antenna for Multi-Band Reception and Transmission, disclosed in U.S. patent application Ser. No. 08/406,421 and incorporated by reference, uses a variable capacitor to tune a multi-band antenna. This design meets the requirements of broad bandwidth and compactness but requires a motor and other moving parts, which are subject to wear and tear, to achieve focused tuning within the broad bandwidth. The Variable Capacitance Antenna disclosure proposes using a conventional delta matching system to match the antenna to a feed line.

Various matching methods and devices are discussed in *The ARRL Handbook for Radio Amateurs* 17-1 to 17-22 (The American Radio League 1992). This text also discusses in depth the relationships between matching devices and bandwidth.

SUMMARY OF THE INVENTION

With the recent assignment of more bands for private and public use, there is a need for multi-band antennas and antennas with broader effective bandwidths. Generally, industry has responded to this need by combining various antenna designs into one antenna which, in some cases, are approaching the size and weight of a log periodic antenna. Alternatively, industry has provided more dedicated antennas for the range of frequencies required.

The constant impedance matching system is similar to the popular delta matching system, but instead of a point contact from a transmission feed line to a radiating element, the constant impedance matching system uses capacitive coupling. Capacitive coupling is achieved by placing capacitive coupling elements proximal to and in parallel with the driven element. Additionally, capacitive coupling elements may be extended by winding a conductive extension around the driven element but having the extension not directly in contact with the driven element. These capacitive coupling elements may be in various forms such as metal rods, metal wire, or even conductive adhesive tape.

These capacitive coupling elements, with or without extensions, allow RF energy to flow to the radiating element at the point of best impedance match. This point changes with frequency, the placement of the antenna, and the working height of the antenna, but it will transfer RF energy at the best matching point regardless of the height of the antenna and the antenna's environment. By following this method of matching, present delta match driven arrays may be modified to have a wider operating bandwidth and lower SWR curve, and the antenna arrays themselves may be cut and tuned for better gain and directive pattern arrangement. When using capacitive coupling elements, the effective bandwidth of an antenna array is limited only by the antenna characteristics and not the matching system.

A switch may be provided to directly connect (i.e., short) and disconnect the capacitive coupling elements from the driven element and allow a choice between the broader frequency response with a flatter SWR curve and a focused frequency response with a sharper SWR curve. Also, use of capacitive coupling elements reduces some frequency sensitivities of an antenna and allows radiating phasing lines to connect a driven element to a secondary element to drive the secondary element in phase or out of phase with the driven element.

A shunt capacitor (or capacitors) may be used with the capacitive coupling elements to provide increased frequency coverage compared to the capacitive coupling elements alone. A capacitor electrically connected to the driven element, but placed at an appropriate distance from the driven element to prevent intercomponent capacitive coupling, promotes phase coherence on both sides of the transmission feed point. A shunt capacitance allows the antenna to have broader gain characteristics and flattens the SWR curve.

According to one embodiment, capacitive coupling elements are used in conjunction with the previously mentioned Variable Capacitance Antenna. Replacing the conventional delta match broadens the frequency response of the system. If one or more motor-driven variable capacitors of the Variable Capacitance Antenna is exchanged for a more commercially available fixed value capacitor, which is small and does not have to be protected from the environment to the same extent as moving parts require, the broad frequency response of the antenna can be retained at the small expense of less focused tuning. This embodiment not only can reduce the number of moving parts, but it also flattens the SWR frequency curve across all designed frequencies.

Another embodiment can be used to match a transmission feed line to a radiating vertical element. When used in association with a fixed capacitor as alluded to above, it can transform a vertical element of approximately forty feet in height to a multi-band antenna for frequencies from as low as 7 MHz to high frequency bands up to 30 MHz, and it could also used in the very high frequency range of 144 MHz and above.

Other advantages of the constant impedance matching system is that the feed point can be moved higher than the conventional feed point at the center or the base of a radiating element, which will provide different gain at a lower radiation angle, by taking advantage of the height of the feed point. This higher feed point location also decreases cosmic noise reception, thus lowering the noise floor.

Another advantage is that a vertical all-band antenna can be used as an environmentally-friendly flag pole or other support by placing the transmission cable within a hollow radiating element. The capacitive coupling elements could be outside the pole but have a low profile. Another advantage is that compact broad-band antennas using capacitive coupling elements will reduce the visual pollution that assorted large arrays, such as the log periodic antenna, bring. Also, the constant impedance matching system can supply higher gain and smaller outline than conventional antennas when used for radio and television reception.

DETAILED DESCRIPTION OF THE PREFERRED EMBODIMENTS

Figure 1:
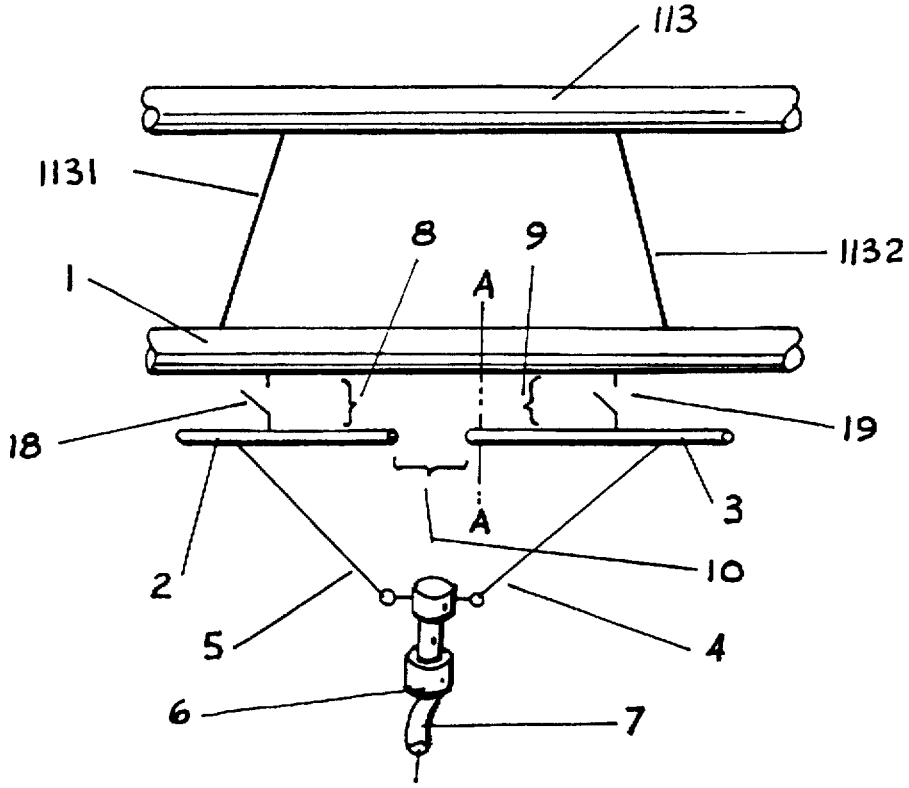
FIG. 1 shows a first embodiment having capacitive coupling elements in the form of coupling rods.

FIG. 1 shows a first embodiment having capacitive coupling elements in the form of coupling rods. Element 1 is a driven element of an antenna preferably made of a lightweight, electrically conductive material, such as aluminum. Element 1 may be part of an antenna array having secondary element 113, and element 1 and can be any length depending on the frequencies of interest. Capacitive coupling elements may be in the form of conductive coupling rods or coupling wires. Coupling rods 2, 3 can be placed in a parallel fashion alongside element 1, but with an optional direct electrical or direct physical connection between the rods 2, 3 and the element 1. If element 1 is approximately thirty-four feet in length, coupling rods 2, 3 may each be approximately two feet in length, with a spacing 10 of approximately four inches between the rods. Note that coupling rods 2, 3 do not necessarily have the same length, nor do they have to be placed symmetrically about the center of the radiating element. Note also that conductive wire can easily be substituted for conductive rods as capacitive coupling elements.

Preferably, connecting wires 4, 5 attached to coupling rods 2, 3 are made of aluminum wire at least one-tenth of an inch in diameter, each approximately two feet long. The connecting wires may be attached at opposite ends 12, 13 of the coupling rods 2, 3 or at any other point along the coupling rods. Connecting wires 4, 5 provide an electrical connection between the coupling rods 2, 3 and an impedance transformer 6 which may have a 4:1 ratio and provide a balanced match to a fifty ohm coaxial cable 7, which is termed an unbalanced transmission line.

Figure 2:
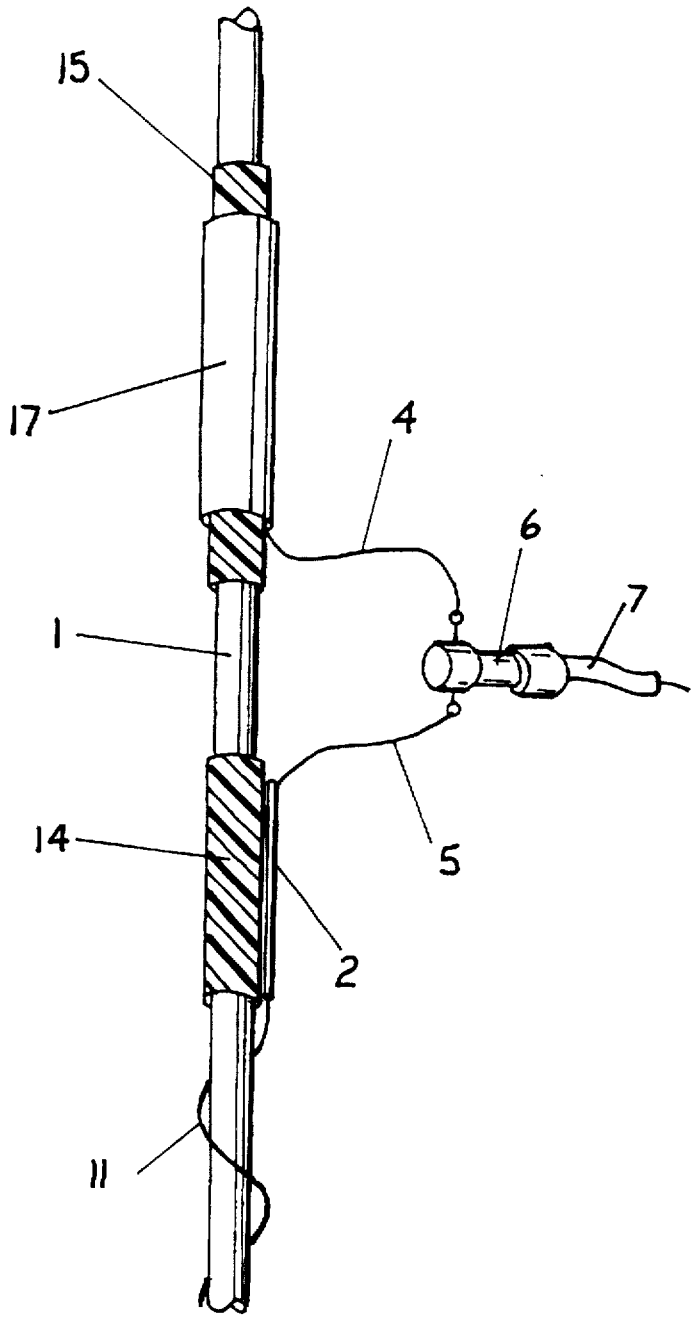
FIG. 2 shows a second embodiment having a dielectric material interface to capacitive coupling elements.

Gaps 8, 9 between element 1 and coupling rods 2, 3 should be as small as possible to ensure optimal capacitive coupling. Gaps 8, 9 of three to four inches, however, generally provide acceptable impedance matching. Note that gaps 8, 9 do not have to be identical. If high voltages are present, a dielectric air gap could be replaced by a suitable dielectric material as shown in FIG. 2.

Switches 18, 19 can be installed to directly connect connecting wires 4, 5 to the radiating element 1 via the capacitive coupling elements 2, 3 as per conventional matching systems (shown in FIGS. 3A, 4A, 5A, 6A, and 6C). Closed switches short the capacitive coupling elements directly to the radiating element. Closing switches 18, 19 makes a fixed point connection from the radiating element to the transmission cable and produces the narrow focused frequency response with sharp SWR curve of conventional matching systems. Opening the switches produces a broadened frequency response with a flattened SWR curve.

One or more radiating phasing connections 1131, 1132 may connect driven element 1 to secondary element 113 in an antenna array when capacitive coupling elements are used. These radiating connections 1131, 1132 may be used to drive secondary element 113 in phase or out of phase with respect to the driven element, because the capacitive coupling elements allow the radiating element to be less frequency and wavelength conscious. Although radiating connections 1131, 1132 are shown as convergent connections, the radiating connections may alternatively be divergent, parallel, or asymmetrical. Note that these radiating phasing connections 1131, 1132 are direct, radiating connections; they are not non-radiating transmission line connections of a specific length, such as quarterwave transmission lines. Also in contrast to quarterwave transmission lines, the lengths of the radiating connections are not as critical.

Figure 1A:
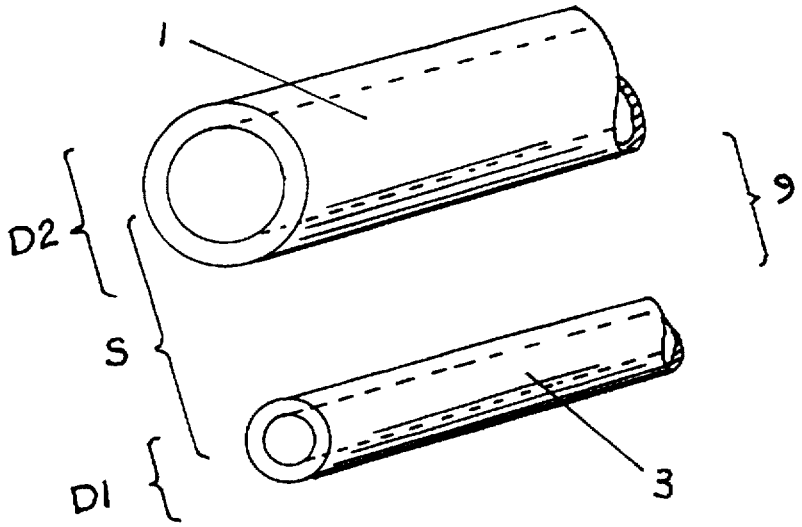
FIG. 1A is a cross section along line A—A of FIG. 1 that details the important dimensions that can affect the degree of coupling capacitance or impedance matching.

FIG. 1A is a cross section along line A—A of FIG. 1 that details the important dimensions that can affect the degree of coupling capacitance or impedance matching. For an element 1 of thirty-four feet in length, $D_1$ could be approximately one-half inch in outside diameter and $D_2$ could be approximately 1¼ inches in outside diameter. The spacing S between the centers of element 1 and rod 3 could be one inch if the dielectric gap 9 is one-eighth of an inch. A small gap is desirable to improve capacitive coupling and reduce the antenna's profile.

A conductive tape or strip may be used along with dielectric tape, instead of coupling rods or coupling wire, to create other forms of capacitive coupling elements. FIG. 2 shows a second embodiment having a dielectric material interface to the capacitive coupling elements. In this embodiment, one capacitive coupling element 2 is in the form of a coupling rod with dielectric material interface 14 and the other capacitive coupling element 17 is in the form of conductive adhesive tape with dielectric material interface 15. A dielectric material, such as Teflon™ tape 14, is wrapped around driven element 1 to create a suitable dielectric material interface between coupling rod 2 and radiating element 1.

This figure also shows conductive extension 11 electrically connected to capacitive coupling element 2. A conductive extension could be used to increase the capacitive coupling available to the system. Preferably, conductive extension 11 is an insulated wire at least one-tenth of an inch in diameter helically wrapped around driven element 1. Alternatively, conductive extension 11 could be a uninsulated wire, and dielectric material interface 14 could be extended to provide an interface for the uninsulated wire. In one embodiment with a capacitive coupling rod of four feet in length, the conductive extension was approximately thirteen feet in length with ten turns along thirteen feet of the driven element. Preferably, the turns are "loose" in order to prevent inductance along the conductive extension.

For the other capacitive coupling element, another dielectric interface 15 is created (or the first dielectric interface could be extended), and conductive tape 17 is wrapped outside of the dielectric interface to achieve capacitive coupling of the coaxial cable 7 through impedance transformer 6 via connecting wire 4. Note that conductive tape 17 may be easily replaced with a conductive sheet of aluminum or other conductive material. Also, the conductive material need not wrap completely around the radiating element.

Note that in any embodiment, any form of capacitive coupling element or dielectric interface may be substituted for another form. For example, coupling rods may be substituted for coupling wires or conductive tape and vice versa. Note that a capacitive coupling element made of wire and a conductive extension made of wire may be a single length of wire loosely wrapped around a length of a driven element. As another example, an air dielectric interface could be substituted for a dielectric material interface such as tape or insulation around a wire.

Figure 3A:
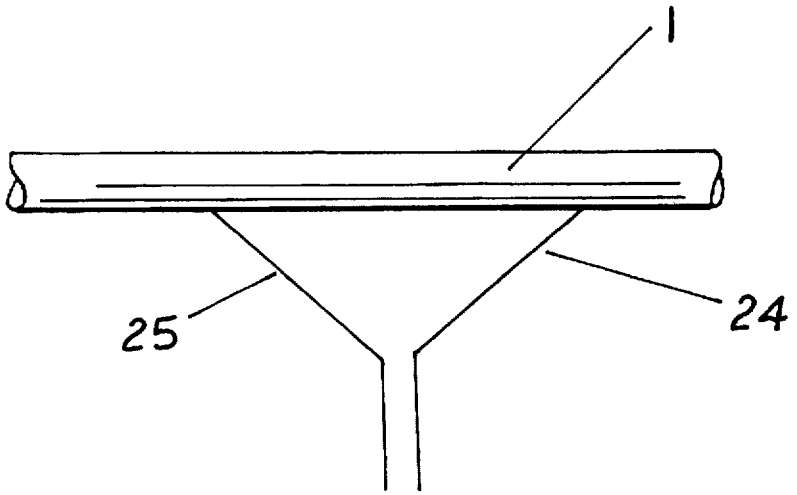
FIG. 3A PRIOR ART
FIG. 3A shows a prior art delta matching system and FIG. 3B shows a delta matching system with capacitive coupling elements.
Figure 3B:
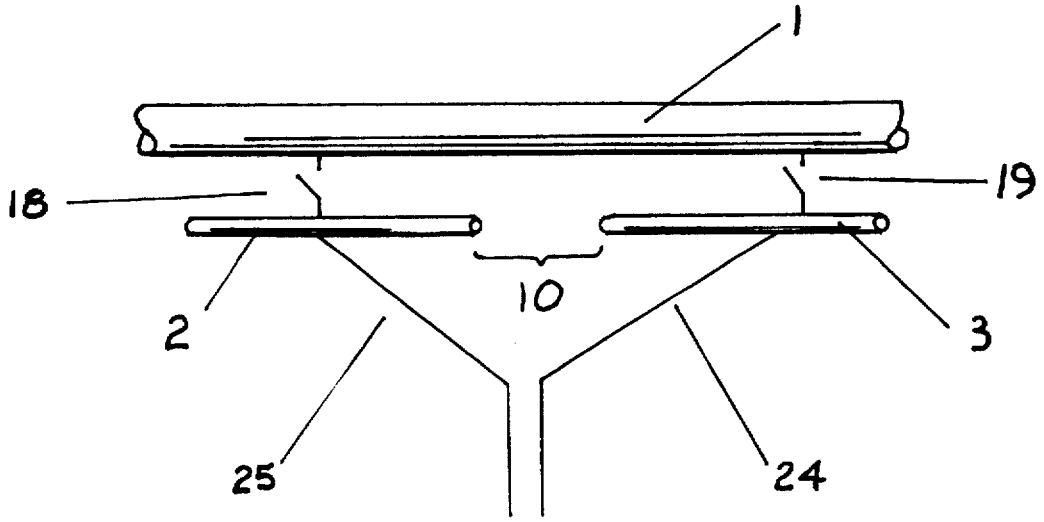

FIG. 3A shows a prior art delta matching system and FIG. 3B shows a delta matching system with capacitive coupling elements in the form of coupling rods. A typical delta matching system as shown in FIG. 3A has balanced lines (or coaxial baluns) 24, 25 attached to element 1 at fixed points of best impedance match for the frequency of interest. Replacing the fixed points with coupling rods 2, 3, as shown in FIG. 3B broadens the frequency response of the system by supplying an impedance match for more than one frequency and flattening the SWR curve.

Figure 4A:
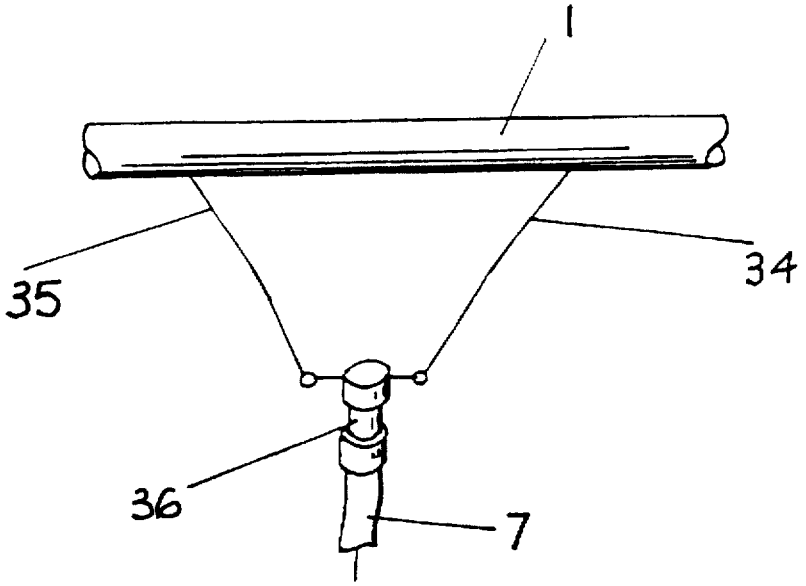
FIG. 4A PRIOR ART
FIG. 4A shows a prior art balanced-to-unbalanced delta matching system and FIG. 4B shows a balanced-to-unbalanced delta matching system with capacitive coupling elements.
Figure 4B:
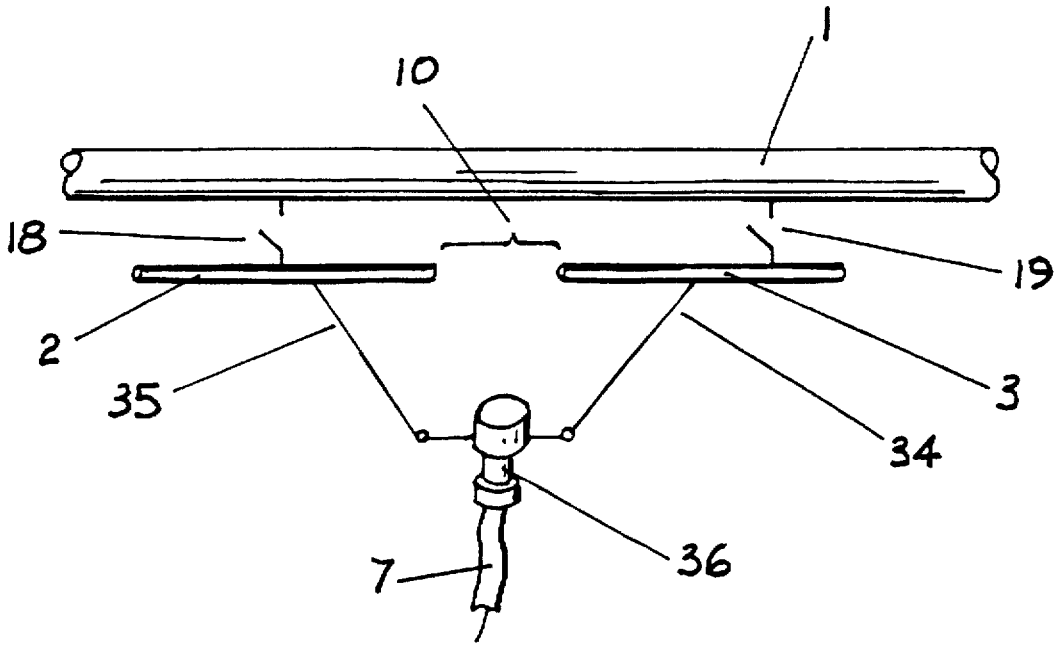

FIG. 4A shows a prior art balanced-to-unbalanced delta matching system and FIG. 4B shows a balanced-to-unbalanced delta matching system with capacitive coupling elements in the form of coupling rods. FIG. 4A shows a delta match with lines 34, 35 attached to a balanced-to-unbalanced transformer 36 connected to a coaxial cable 7. In this situation, the frequency response and SWR of the system may be improved by replacing the fixed-point connections of the prior art matching system with coupling rods 2, 3 as shown in FIG. 4B.

Figure 5A:
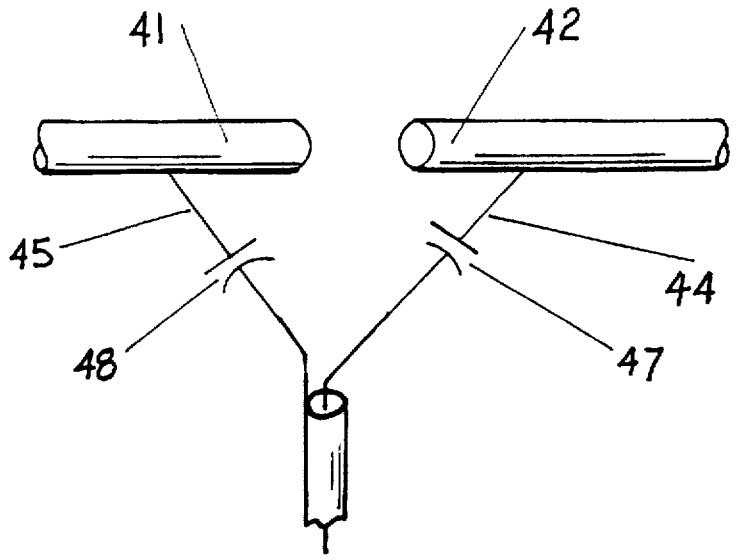
FIG. 5A PRIOR ART
FIG. 5A shows a prior art delta matching system to a severed element and FIG. 5B shows a delta matching system with capacitive coupling elements to a severed element.
Figure 5B:
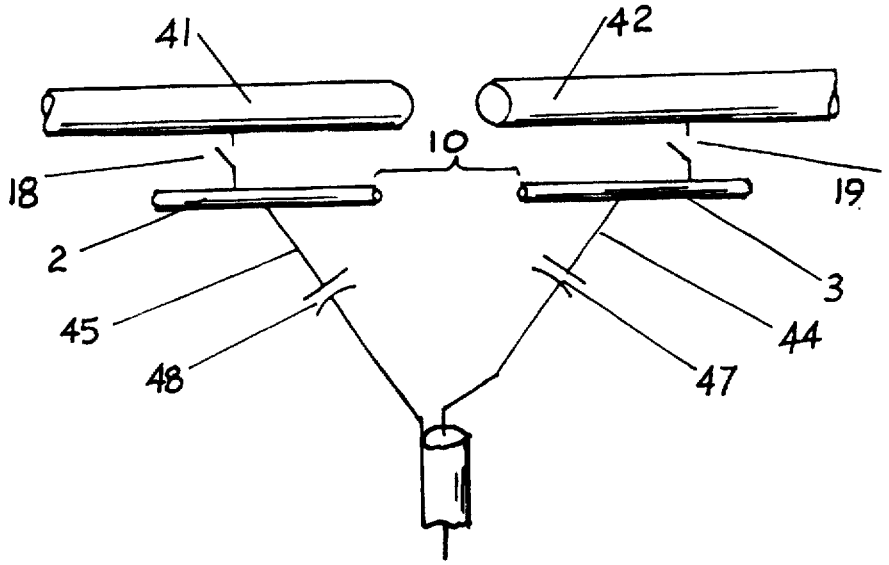

FIG. 5A shows a prior art delta matching system to a severed element and FIG. 5B shows a delta matching system with capacitive coupling elements to a severed element. Coaxial cable 7 may be connected to portions of severed element 41, 42 with connecting lines 44, 45 with or without individual capacitors 47, 48. Coupling rods 2, 3 make the individual capacitors superfluous, and the frequency response and SWR of the system will be improved. Note, however, that individual capacitors 47, 48 may be retained for adjustment purposes.

Figure 6A:
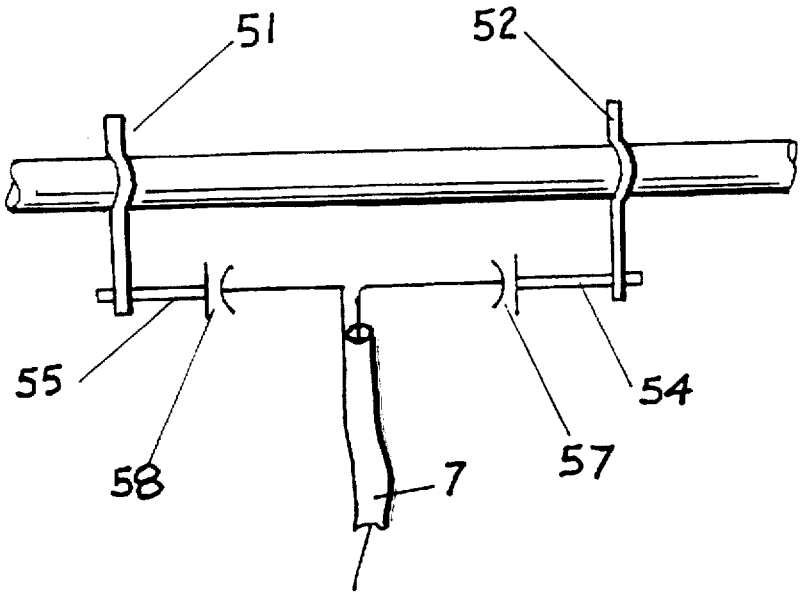
FIG. 6A PRIOR ART
FIG. 6A shows a prior art T matching system and FIG. 6B shows a T matching system with capacitive coupling elements.
Figure 6B:
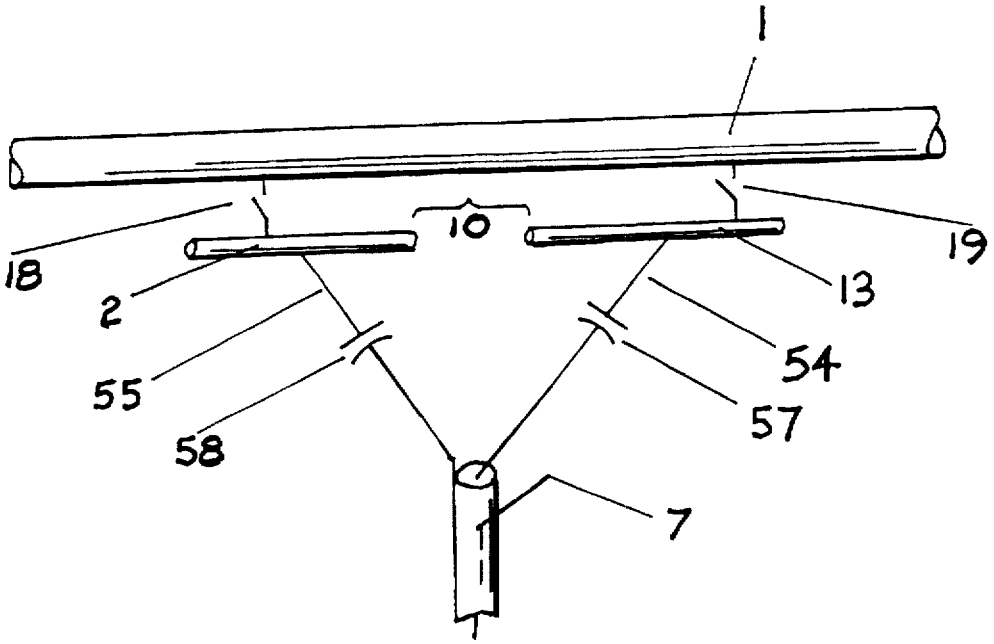

FIG. 6A shows a prior art T matching system and FIG. 6B shows a T matching system with capacitive coupling elements in the form of coupling rods. In a T matching system, coaxial cable 7 is attached to element 1 through lines 54, 55 and individual capacitors 57, 58 using conductive shorting bars 51, 52 as shown in FIG. 6A. Replacing the shorting bars with coupling rods 2, 3 as shown in FIG. 6B results in a broader frequency response and flatter SWR. Again, capacitive coupling elements 2, 3 make individual capacitors 57, 58 unnecessary except for possible adjustment purposes.

Figure 6C:
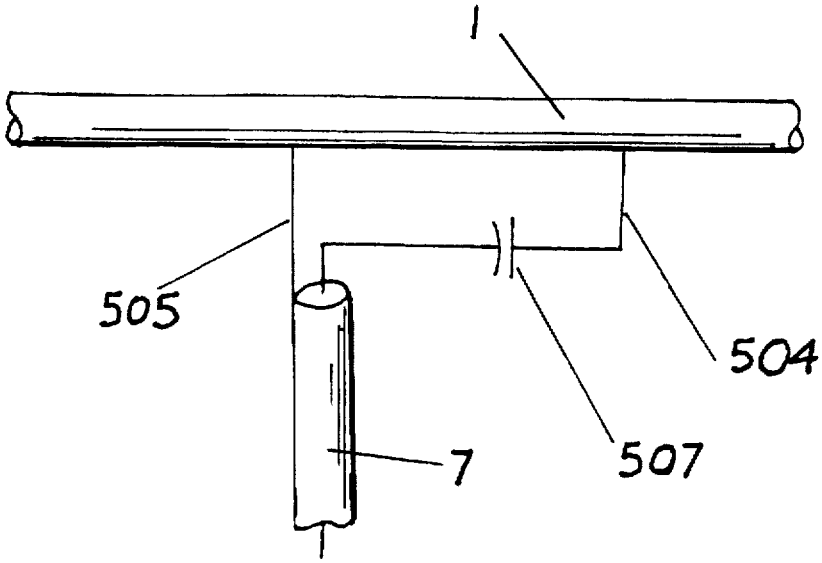
FIG. 6C PRIOR ART
FIG. 6C shows a prior art gamma matching system and FIG. 6D shows a gamma matching system with capacitive coupling elements.
Figure 6D:
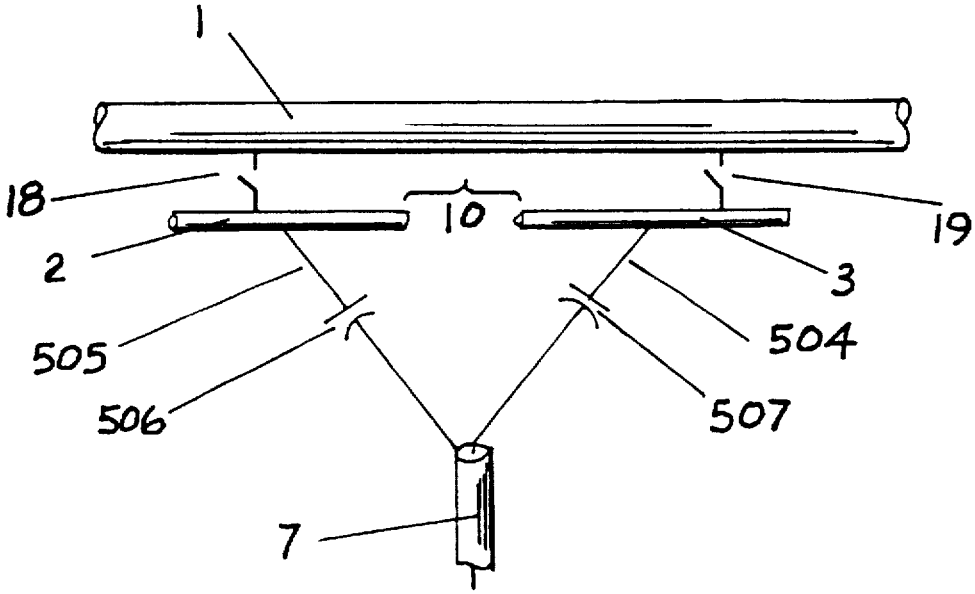

FIG. 6C shows a prior art gamma matching system and FIG. 6D shows a gamma matching system with capacitive coupling elements in the form of coupling rods. Gamma matches are used to connect a coaxial cable 7 directly to driven element 1 through lines 504, 505 and single capacitor 507 as shown in FIG. 6C. Gamma matches are commonly used to feed stacked Yagi antenna arrays. Replacing the fixed point connections of the gamma match with capacitive coupling elements 2, 3 removes the need for capacitor 507 (however, capacitors 506, 507 may be used for adjustment purposes), broadens the bandwidth of the antenna, and flattens the SWR curve.

Figure 7:
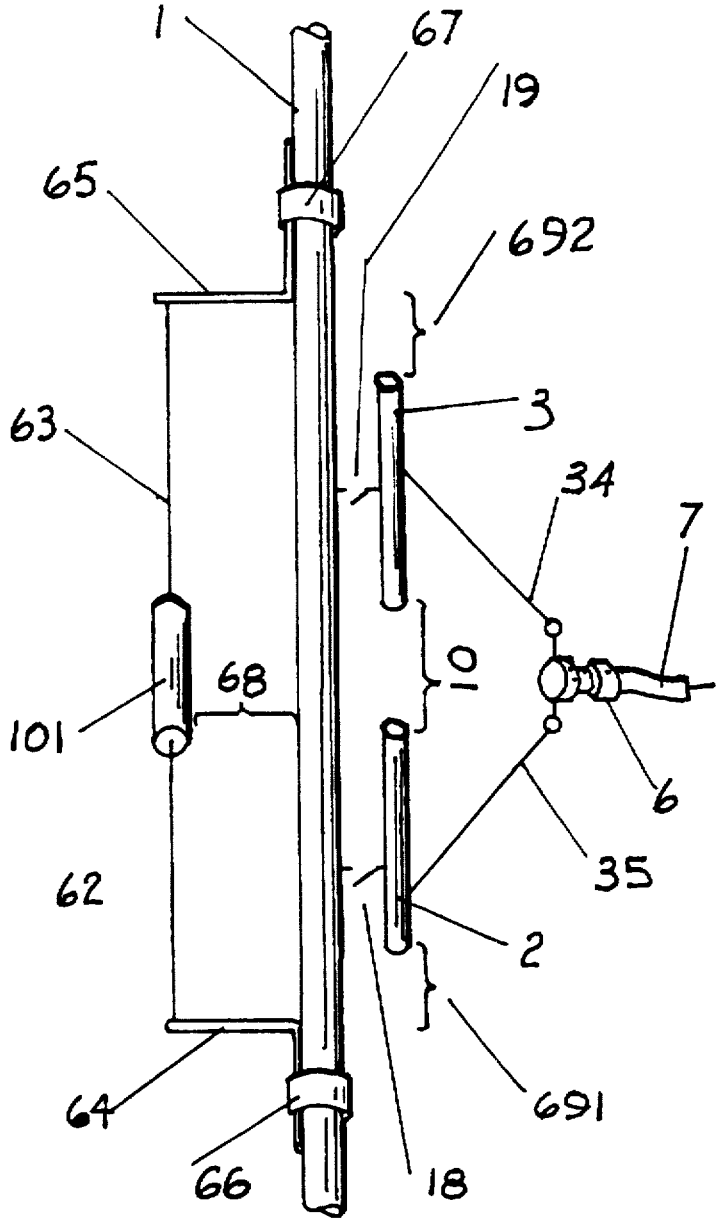
FIG. 7 shows a third embodiment having a shunt capacitance.

FIG. 7 shows a third embodiment having a shunt capacitance. In addition to the elements shown in FIG. 1, FIG. 7 includes a high voltage capacitor 101 electrically connected to and positioned an appropriate distance from element 1. For a frequency range of 7–155 MHz, this capacitor may have a fixed value of approximately 10–100 pf and 4 Kv with-stand voltage. A variable capacitor, of course, may be used instead of a fixed capacitor. A shunt capacitance may mounted on any unsevered radiating element. Thus, only the embodiment shown in FIG. 5B would not be improved by a shunt capacitor.

Capacitor 101 may be electrically connected to stand-off arms 64, 65 by aluminum wire 62, 63 or other conductive material. Stand-off arms 64, 65 may be made of aluminum rod of one-quarter inch diameter and bent in a fashion that enables them to be clamped to element 1 for electrical connection. Clamps 66, 67 may be common pipe clamps that hold capacitor 101 and wires 62, 63 at a certain distance 68 away from element 1 to prevent intercomponent capacitive coupling. With an element 1 of thirty-four feet in length and 1¼ inches in outside diameter, distance 68 is preferably six inches. Of course, other methods and elements may be used to position capacitor 101 an appropriate distance 68 from element 1.

The distance 691, 692 of stand-off arms 66, 67 from coupling rods 2, 3 can be approximately six inches. Note, however, that the shunt capacitor does not have to be positioned directly centered across from the coupling rods.

Instead, the shunt capacitor may be offset from the center of the coupling rods. Additionally, stand-off arms 66, 67 do not have to be positioned symmetrically around coupling rods 2, 3. Instead, stand-off arms may be positioned asymmetrically with respect to the coupling rods, or both stand-off arms may even be on the same side of the coupling rods.

The third embodiment provides a radiating system with increased gain compared to the embodiments without a shunt capacitance. A shunt capacitor (or capacitors) in conjunction with capacitive coupling elements provides for increased frequency coverage when compared to the capacitive coupling elements alone as shown in FIGS. 1 and 2. Notably, this embodiment allows usage of all amateur radio frequency bands between 7 MHz and 30 MHz and even 144 MHz, all with an acceptable SWR in both the horizontal and vertical planes.

Figure 8:
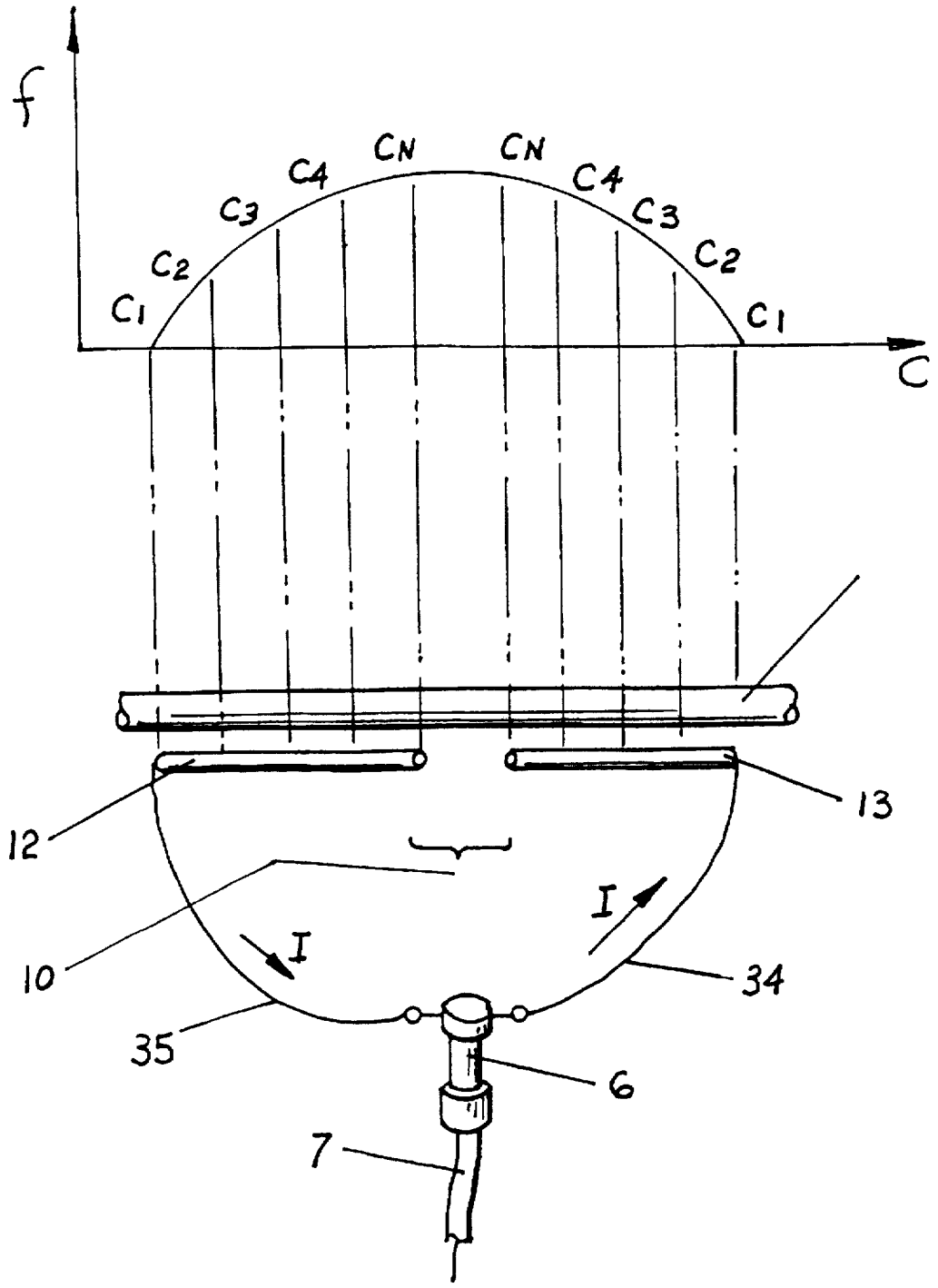
FIG. 8 shows how a current feed searches for a good impedance match to make an efficient transition point.

FIG. 8 shows how a current feed searches for an impedance match to make an efficient transition point. Graph C with points $C_1$, $C_2$, $C_3$, $C_4$, . . . , $C_N$ graphically represent the changing impedance amplitude points on driven element 1 with respect to frequency f. Depending on the impedance amplitude at a given frequency, current I will capacitively couple to radiating element 1 at point $I_1$, $I_2$, $I_3$, $I_4$, . . . , or $I_N$ on coupling rods 2, 3. This optimal impedance matching provides a broader frequency response than conventional matching techniques.

Figure 9:
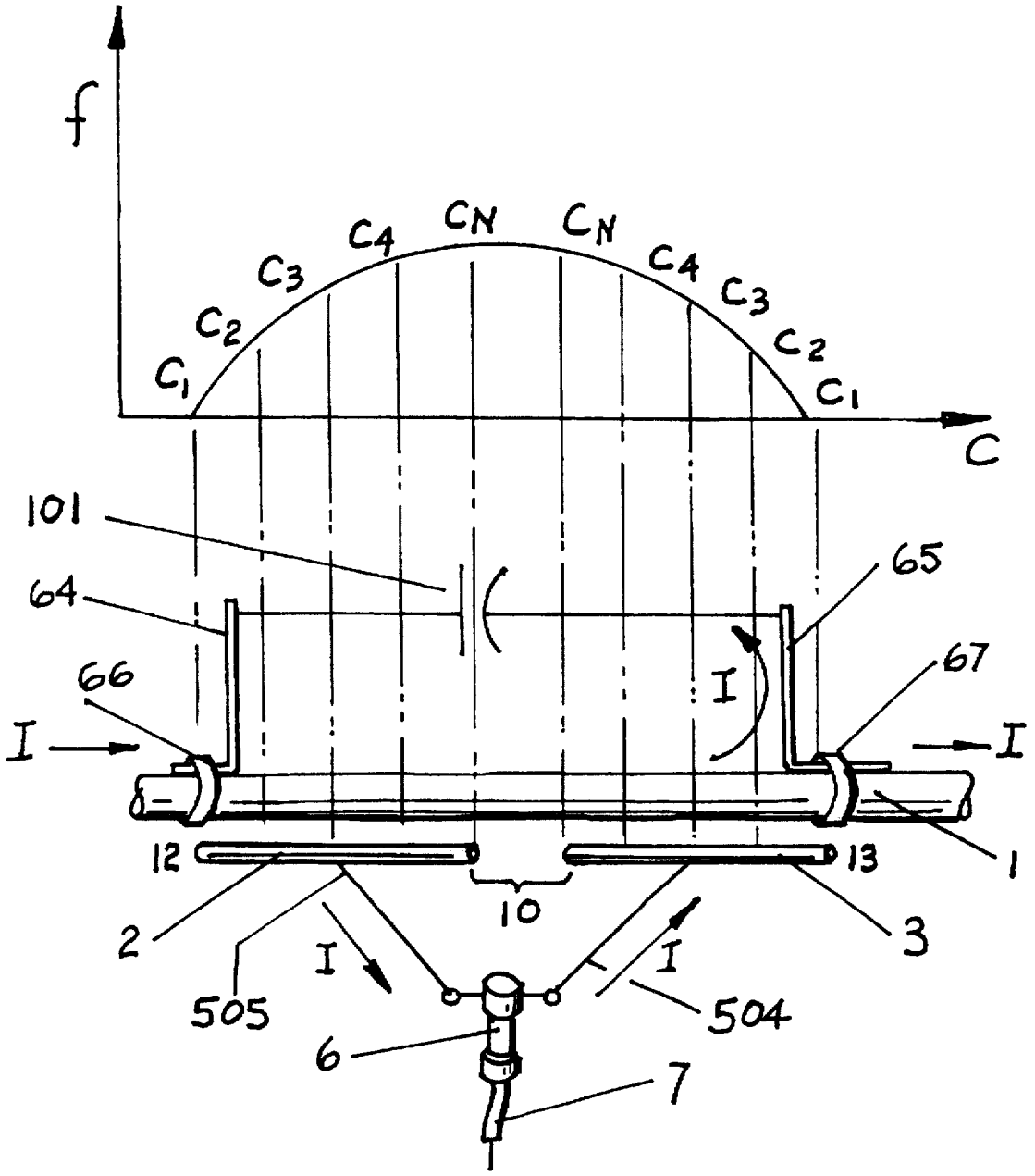
FIG. 9 shows how the third embodiment can provide additional band coverage and gain in addition to the broadening effect supplied by the capacitive coupling elements.

FIG. 9 shows how the third embodiment can provide additional bandwidth coverage and gain in addition to the broader frequency response effect supplied by the capacitive coupling elements alone. Capacitor 101 in conjunction with coupling rods 2, 3 creates a current flow I that is in phase on both sides of the feed point. This phase coherence allows the antenna to have broader gain characteristics and flattens the SWR curve to create a desirable lower SWR.

Figure 10:
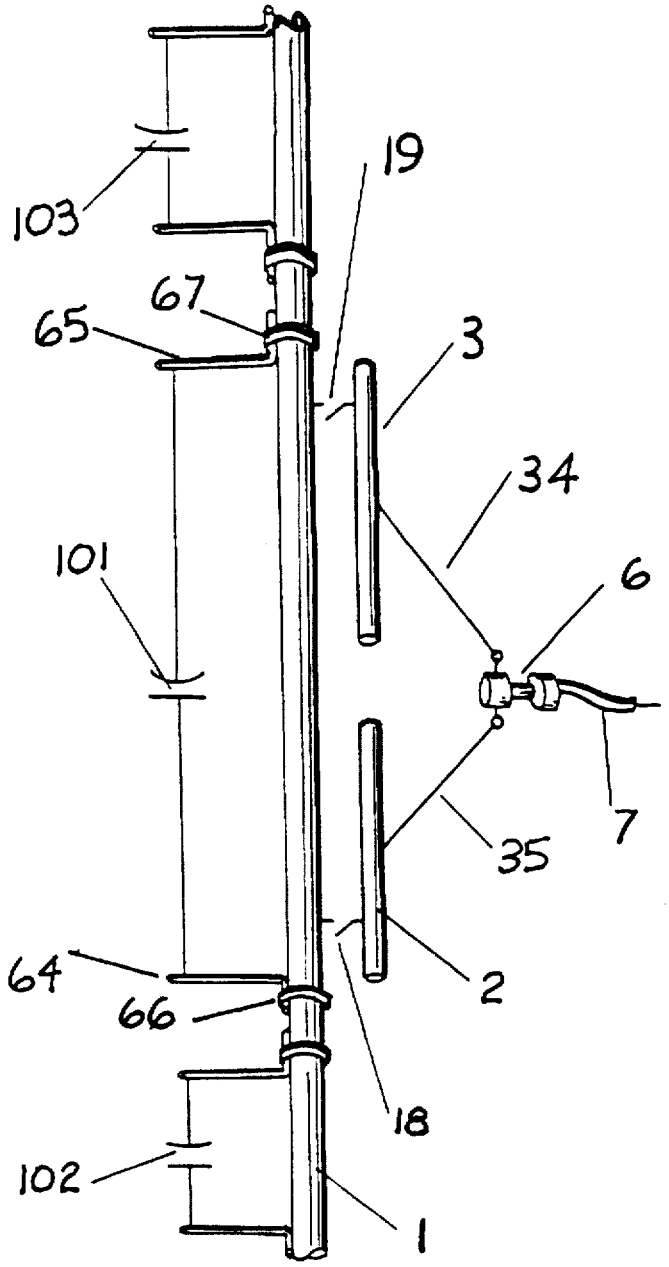
FIG. 10 shows a fourth embodiment having multiple shunt capacitances.

FIG. 10 shows a fourth embodiment having multiple shunt capacitances. As noted before, the position of a shunt capacitance with respect to the capacitive coupling elements is not critical. In fact, several individual capacitors 101, 102, 103 may be placed along driven element 1 to improve the electrical characteristics of the antenna.

Figure 11:
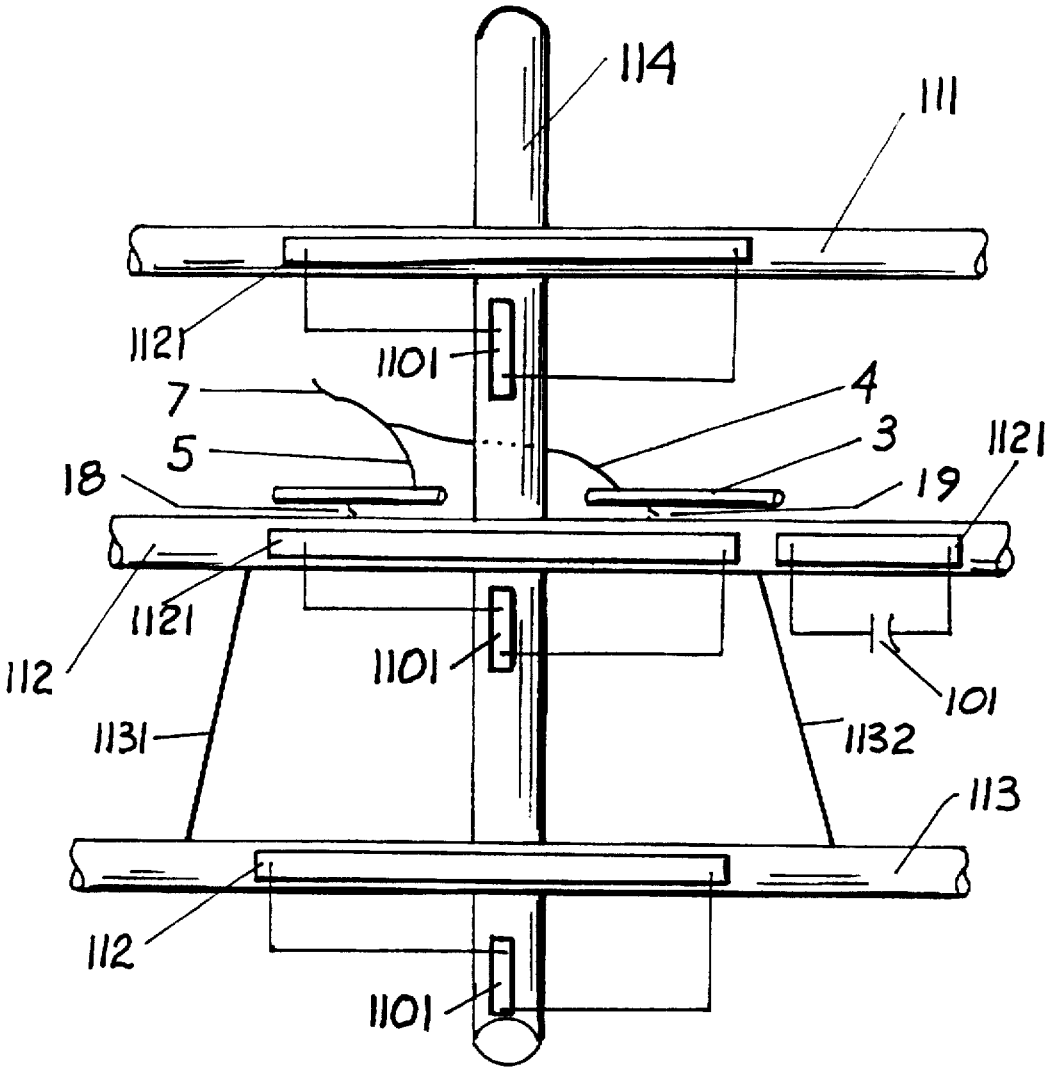
FIG. 11 shows a fifth embodiment having variable capacitance portions.

FIG. 11 shows a fifth embodiment having variable capacitance portions. This embodiment replaces the delta match of a Variable Capacitance Antenna with capacitive coupling elements in the form of coupling rods 2, 3. The Variable Capacitance Antenna shown is a three-element antenna with driver element 112, director element 111, and reflector element 113 mounted on common support boom 114. Each element is associated with a variable capacitor portion 1101 and an unwound inductor portion 1121 (i.e., a length of the element). The frequency response and SWR of the system may be improved by inserting coupling rods 2, 3 as shown, connected by connecting wires 4, 5 to transmission cable 7.

If desired, one or more of the variable capacitor portions 1101 may be replaced by an inexpensive fixed-value capacitor. Although the sharpness of frequency tuning will be reduced by the removal of a variable capacitor portion, the capacitive coupling elements allow the antenna to retain a broad frequency response and high gain while contributing an improved SWR curve.

Also, radiating phasing connections 1131, 1132 may be used to connect driven element 111 to a parasitic element, such as director element 111 or reflector element 113, when switches 18, 19 are open. Although radiating connections 1131, 1132 are shown as divergent connections in this figure, the radiating connections may alternatively be convergent, parallel, or asymmetrical. These radiating connections 1131, 1132 may be used to drive a parasitic element in phase or out of phase with respect to the driven element, because the capacitive coupling elements allows the radiating element to be less frequency and wavelength conscious.

Figure 12:
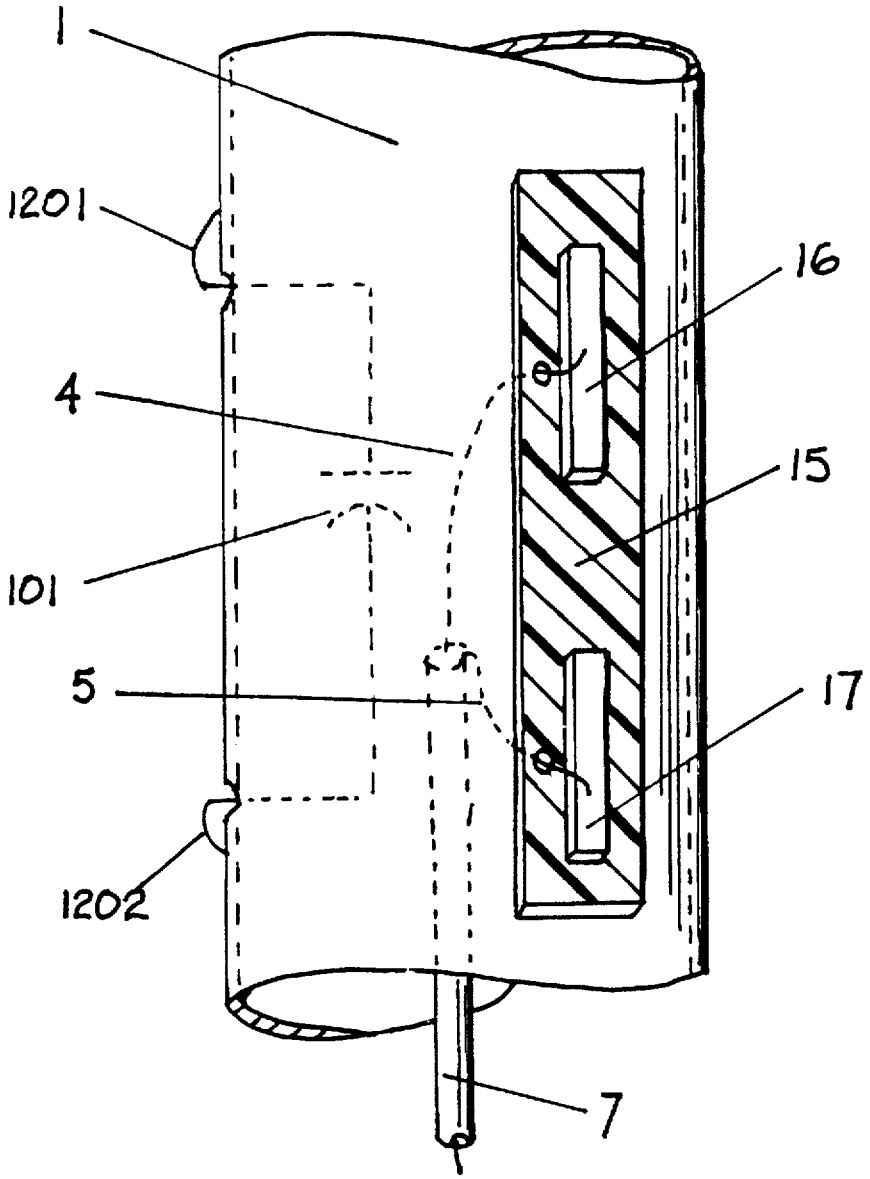
FIG. 12 shows a sixth embodiment having a transmission feed line inside a driven element.

FIG. 12 shows a sixth embodiment having a transmission feed line inside a driven element. This embodiment is preferably for use in a vertical all-band antenna. Capacitive coupling elements 16, 17 in the form of strips of conductive adhesive tape are attached to the outside of driven element 1 using a dielectric interface 15, such as Teflon™ tape. Connecting wires 4, 5 travel through insulated holes in the radiating element, which are hidden and electrically shielded, and connect the capacitive coupling elements 16, 17 to coaxial cable 7 located inside the driven element 1. Shunt capacitance 101 may also be placed inside the driven element and connected to the outer surface of the driven element through electrically shielded openings 1201, 1202. Note that shunt capacitance can be placed anywhere along the length of the driven element, and the shunt capacitance could also be attached to the outside of the driven element if desired. A shunt capacitance used with this embodiment can transform a vertical driven element of approximately forty feet in height to a multi-band antenna for frequencies from as low as 7 MHz to high frequency bands up to 30 MHz, and it could also used in the very high frequency range of 144 MHz and above.

Although the present invention and its advantages has been described in detail, it should be understood that various changes, substitutions, and alterations can be made without departing from the spirit and scope of the invention as defined by the appended claims.

I claim:

1. A constant impedance matching system comprising:

a radiating element exhibiting an elongated cavity;

a plurality of elongated capacitive coupling elements located proximal to and in parallel to the radiating element and electrically connected to a transmission feed line for capacitively coupling the transmission feed line to the radiating element;

a plurality of switch means electrically connected between the radiating element and the capacitive coupling elements for broad banding and providing a low standing wave ratio;

a plurality of radiating phasing transmission lines directly connecting the radiating element to a secondary radiator for driving the secondary radiator in phase or out of phase with the radiating element; and a shunt capacitance being mounted at a predetermined distance away from the radiating element.

2. A constant impedance matching system according to claim 1, further comprising:

a dielectric interface between the radiating element and the capacitive coupling elements.

3. A constant impedance matching system according to claim 2, wherein the dielectric interface is air.

4. A constant impedance matching system according to claim 2, wherein the dielectric interface is dielectric material.

5. A constant impedance matching system according to claim 1, further comprising:

a variable capacitor electrically connected to the radiating element for focused frequency tuning.

6. A constant impedance matching system according to claim 1, wherein the capacitive coupling elements comprise conductive rods.

7. A constant impedance matching system according to claim 1, wherein the capacitive coupling elements comprise conductive wires.

8. A constant impedance matching system according to claim 7, wherein the conductive wires are insulated.

9. A constant impedance matching system according to claim 1, wherein the capacitive coupling elements comprise conductive adhesive tape.

10. A constant impedance matching system according to claim 1, wherein the transmission feed line is located inside of the elongated cavity.

11. A constant impedance matching system according to claim 1, further comprising an insulated wire electrically connected to the capacitive coupling elements for increasing the capacitive coupling of the transmission feed line to the radiating element.

12. A constant impedance matching system according to claim 1, wherein the capacitive coupling elements are located outside of the elongated cavity.

13. A constant impedance matching system according to claim 1, wherein the shunt capacitance is located inside of the elongated cavity.

* * * * *